US005152455A

United States Patent [19]

Palmers

[11] Patent Number: 5,152,455

[45] Date of Patent: Oct. 6, 1992

[54] DEVICE FOR APPLYING A LIQUID OR PLASTIC SUBSTANCE

[75] Inventor: Göran Palmers, Askim, Sweden

[73] Assignee: Institutet for Verkstadsteknisk Forskning, Sweden

[21] Appl. No.: 636,674

[22] Filed: Jan. 2, 1991

Related U.S. Application Data

[63] Continuation-in-part of Ser. No. 401,439, Sep. 13, 1989, abandoned.

[30] Foreign Application Priority Data

Mar. 11, 1987 [SE] Sweden ..... 8701034
Mar. 11, 1988 [WO] PCT Int'l Appl. ... PCT/SE88/00128

[51] Int. Cl.[5] ..... B67P 5/08
[52] U.S. Cl. ..... 239/73; 239/583
[58] Field of Search ..... 239/68, 71, 73, 327, 239/331, 337, 95; 251/61.3, 61.5; 222/209, 225, 386.5; 417/395

[56] References Cited

U.S. PATENT DOCUMENTS 3,403,818 10/1969 Enssle ..... 222/359 X
3,482,777 12/1969 Quinn ..... 251/61.5 X
4,030,640 6/1977 Citrin et al. ..... 222/207

*Primary Examiner*—Andres Kashnikow
*Assistant Examiner*—Kevin P. Weldon
*Attorney, Agent, or Firm*—Ostrolenk, Faber, Gerb & Soffen

[57] ABSTRACT

A device for dispensing a string or dab of liquid or plastic substance, such as putty, glue, paint or lubricant, to an object includes a pump for feeding the substance through a conduit to a nozzle having a fine discharge opening. A booster is connected to the conduit between the pump and the nozzle and a pressure medium is supplied to the booster. A substance control valve controls flow of the substance through the nozzle, the substance control valve being connected to the pressure medium and including a valve body which is biased in a closing direction by the substance and which is biased in an opening direction by the pressure medium via an actuator. The actuator includes a pressure member, one side of which is actuated by the pressure medium and the opposite side of which is actuated by the substance, the area of said pressure member being considerably larger than the area of said valve body. The device further includes a pressure medium control valve for controlling the substance control valve.

9 Claims, 3 Drawing Sheets

DEVICE FOR APPLYING A LIQUID OR PLASTIC SUBSTANCE

This is a continuation-in-part application of pending U.S. Ser. No. 07/401,439, filed Sep. 13, 1989 now abandoned.

The present invention refers to a device for applying a string or dab of liquid or plastic substance, e.g. putty, glue, paint, lubricant or the like, to an object, and incorporating a pump for feeding the substance to at least one nozzle provided at distance from the object.

BACKGROUND OF THE INVENTION

When applying liquid substances, such as glue, there are problems of providing the correct volume in the correct spot. As the application speed and also the velocity of the object may vary, it is also necessary that the flow of glue can be varied. Today's equipments can not vary the flow swiftly and long time elapses from the glue leaves the nozzle until it has been applied on the object. It is also expedient to feed out the glue downwards, as it flows out of the nozzle, but difficulties may arise when the nozzle is pointing upwards. It may further be difficult for viscous glue to adhere to the object. Furthermore after-flow or dripping from the nozzle must be avoided.

PURPOSE AND MOST IMPORTANT FEATURES OF THE INVENTION

The purpose of the invention is to provide a device, which eliminates the above mentioned drawbacks, and which applies the glue thus that:

1. it flows straight between the object and the nozzle independent of spraying direction and distance,
2. the transfer time for the substance between nozzle and object is neglectable,
3. the regulation speed for the flow is so rapid, that correct volume is obtained also when the application speed varies,
4. it shall be possible to stop and start the flow so rapidly, that a distinct start and a distinct end of the string/dab is obtained without after-flow and dripping.

These objects have been obtained by a device comprising a nozzle including a fine discharge passage;

a first conduit which is connected to the nozzle;

a pump for feeding the substance through the conduit to the nozzle;

a booster which is connected to the conduit between the pump and the nozzle;

pressure medium supplying means for supplying pressure medium to the booster, the pressure medium supplying means including a second conduit, the second conduit being connected to the booster;

a substance control valve for controlling flow of the substance through the nozzle, the substance control valve being connected to the pressure medium and including a chamber which is in fluid communication with the discharge passage of the nozzle;

the substance control valve further including: a valve seat located between the first conduit and the chamber;

a valve body which is biased in a closing direction by the substance and which is biased in an opening direction by the pressure medium;

an actuator located within said chamber for moving the valve body away from said valve seat, said actuator is connected to the pressure medium and comprises a pressure member, one side of which is actuated by the pressure medium and the opposite side of which is actuated by the substance, the area of said pressure member is considerably larger than the area of said valve body; and said device further including a pressure medium control valve which upon actuation will cause the pressure medium to act upon said pressure element so as to move the valve body in an opening direction, thereby dispensing the substance through the nozzle.

DESCRIPTION OF THE DRAWINGS

The invention hereinafter will be described with reference to the accompanying drawing, which shows some embodiments.

DESCRIPTION OF EMBODIMENTS

Figure 1A:
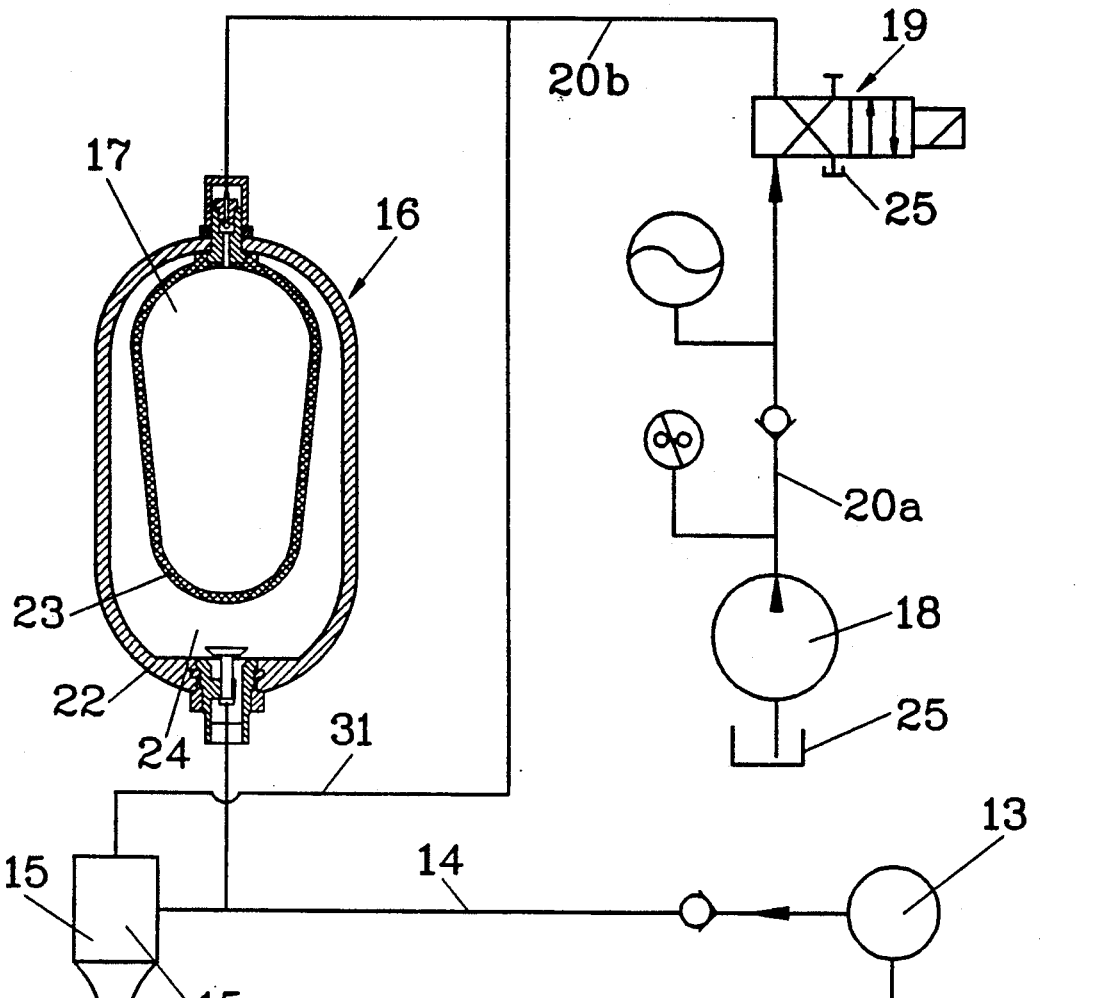
FIG. 1A shows schematically a conduit diagram for the device according to the invention.

The device according to FIG. 1A incorporates a container 11 for a substance 12, e.g. glue, which by a pump 13, via a feed conduit 14 is pumped to a nozzle 15*a*. To the feed conduit 14 is also connected a booster 16, which on the pressure medium side 17 is connected to a pressure medium system, e.g. a hydraulic system. This incorporates i.a. a pump 18 and a directional valve 19 in the feed conduit 20 between the booster 16 and the pump 18.

The nozzle 15*a* is provided with a very thin discharge passage 21, e.g. having a diameter of 0.4 mm, the flow resistance of which is bigger than the pump pressure of e.g. 5 bar, delivered by the pump 13. The booster 16 preferably consists of an accumulator, i.e. a pressure vessel 22, in which is provided an elastic wall 23, which may be a bladder, a piston, a membrane or the like, and the inner compartment 17 of which is connected to the pressure medium conduit 20, thus that the substance is pressurized, e.g. with a pressure of 100–400 bars.

The nozzle 15*a* is directly connected to a control valve 15, which, in the embodiment shown in FIG. 1A, is controlled by the valve 19. In the embodiment shown in FIG. 1B the control valve 15 is controlled by a servo valve 32 independently of the directional valve 19. The servo valve 32 controls the pressure of the pressure medium acting on the control valve 15. This causes a very accurate adjustment of the jet from the nozzle 15*a* independent of the supply of pressure medium to the booster 16.

Figure 2:
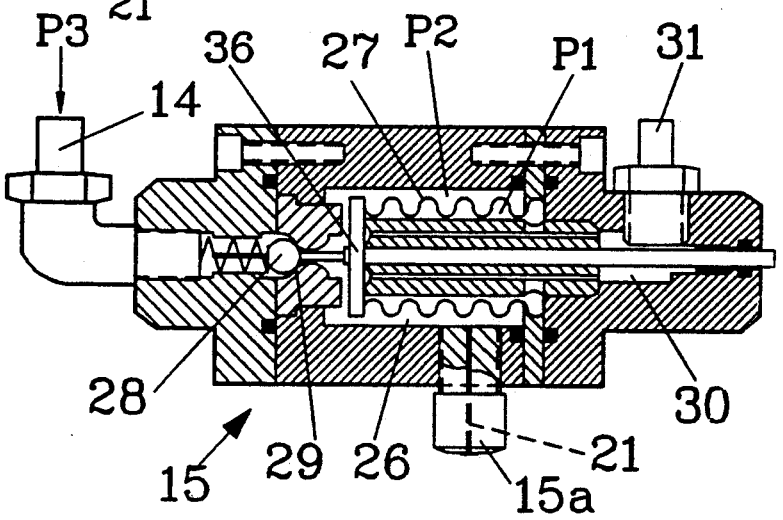
FIG. 2 shows a section through a nozzle forming part of the device according to the invention.

The control valve 15 shown in FIG. 2 consists of chamber 26 provided upstreams of the nozzle discharge passage 21, in which chamber is provided an actuator, which in this embodiment is a bellows 27. The actuator may also be a piston or the like.

A valve body 28 is actuated by the bellows, which valve body in one of its end positions under influence of a spring, sealingly engages a valve seat 29, thereby preventing passage of substance from the feed conduit 14 to the chamber 26. The inner side of the bellows 27 and the space 30, are via a conduit 31 connected to the pressure medium conduit 20*a*. The bellows 27 is at its end facing the valve body 28 provided with a pressure element 36, one side of which is actuated by the hydraulic pressure medium and the opposite side of which is actuated by the substance medium.

The connection of the inner 30 of the bellows 27 to the pressure medium, which also acts upon the accumulator and thus on the glue, means that the valve body 28 is hydraulically balanced between the pressurized substance and the hydraulic pressure medium. The area of the pressure element 36 is considerably larger than the area of the valve body 28. This means that the pressure of the hydraulic pressure medium can be correspondingly lower as compared to the pressurized substance in order to balance this and cause the valve body to open.

If $P_1$ is the pressure of the pressure medium acting on the pressure element 36, $P_2$ is the pressure of the substance medium located in the chamber 26 and acting on the pressure element 36, $P_3$ is the pressure of the substance medium acting on the valve body 28, $A_1$ is the area of the pressure element 36 and $A_2$ is the area of valve body 28 a pressure equilibrium is established when:

$$A_1 \cdot P_1 = A_1 \cdot P_2 + A_2 \cdot (P_3 - P_2)$$

When the valve body 28 has opened it will act as a throttle valve reducing the pressure of the substance medium, so that the pressure of the substance medium in the chamber 26, $P_2$, and thus the pressure of substance dispensed through the nozzle 15*a*, is equal to and controlled by the pressure of the pressure medium, $P_1$, which is adjustable by means of the servo valve 32. As is explained above the valve body 28 is hydraulically balanced between the pressurized substance and the hydraulic pressure medium. This means that the flow through the nozzle 15*a* is equal to the flow in conduit 14 minus the flow in conduit 31.

In spite of the rather high pressure, of the pressurized substance, the valve body in this manner may be adjusted with very small tolerances, thus that exact flows of substance are discharged by the nozzle 15*a*. The bellows and the valve body 28 thereby will make a very small movement (some tenths of a millimeter), which however in view of the small diameter of the nozzle discharge passage is quite sufficient for obtaining distinct glue strings, dabs or the like.

The device according to the embodiment shown in FIG. 1A operates in the following manner. The substance 12 is pumped from the container 11 by means of the pump 13, via the feed conduit 14 at one hand to the nozzle 15*a* and on the other hand to the booster 16. As the resistance in the discharge passage 21 of the nozzle 15*a* is too big, the substance will be supplied to the space 24 of the pressure vessel, which is filled to a certain degree. Excess oil, i.e. the pressure medium, contained in the chamber 17 inside the wall 23, is urged via the conduit 20*b* back to the oil container 25. If the substance shall be pressurized and a string of the glue shall be discharged, then the valve 19 is actuated thus that the pump 18 may exert a hydraulic pressure on the interior of the bladder 23, which is thereby expanded. The pressure element 36 will move towards the left according to FIG. 2 and open the valve 28, but before the valve 28 opens the substance in the chamber 26 will be compressed, so that substance is instantly delivered through the nozzle 15*a* even shortly before the valve 28 has opened. The booster 16 increases the pressure of the substance, which is delivered by the pump 13 at a pressure of e.g. 5 bars, up to a much higher pressure sufficient for causing the substance to be pressed through the fine discharge passage 21 of the nozzle 15*a*. A pressure of about 400 bars can be obtained by the booster 16.

Figure 1B:
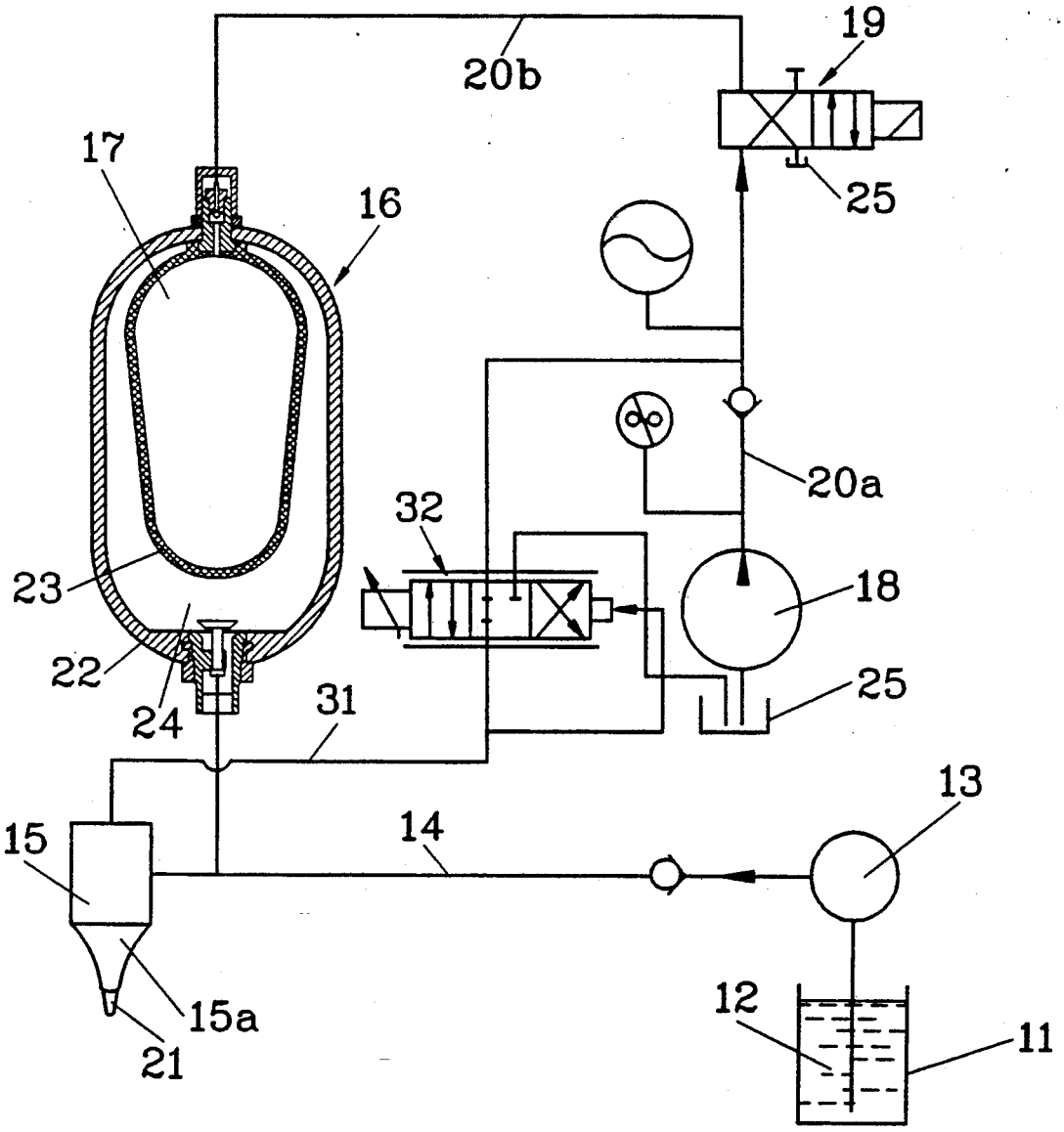
FIG. 1B shows a conduit diagram according to FIG. 1A but of a modified embodiment.

The device according to the embodiment shown in FIG. 1B operates in a similar way, except that the control valve 15 is controlled by the servo valve 32 independantly of the the directional valve 19 and the supply of hydraulic pressure medium to the booster 16, which is discussed above.

When it is required that the accumulator is filled valve 19 switches over, thus that the interior of the bladder 23 is connected to the oil container 25, which means that room 17 will have mainly zero pressure, and the pump 13 can fill up the accumulator.

Figure 3:
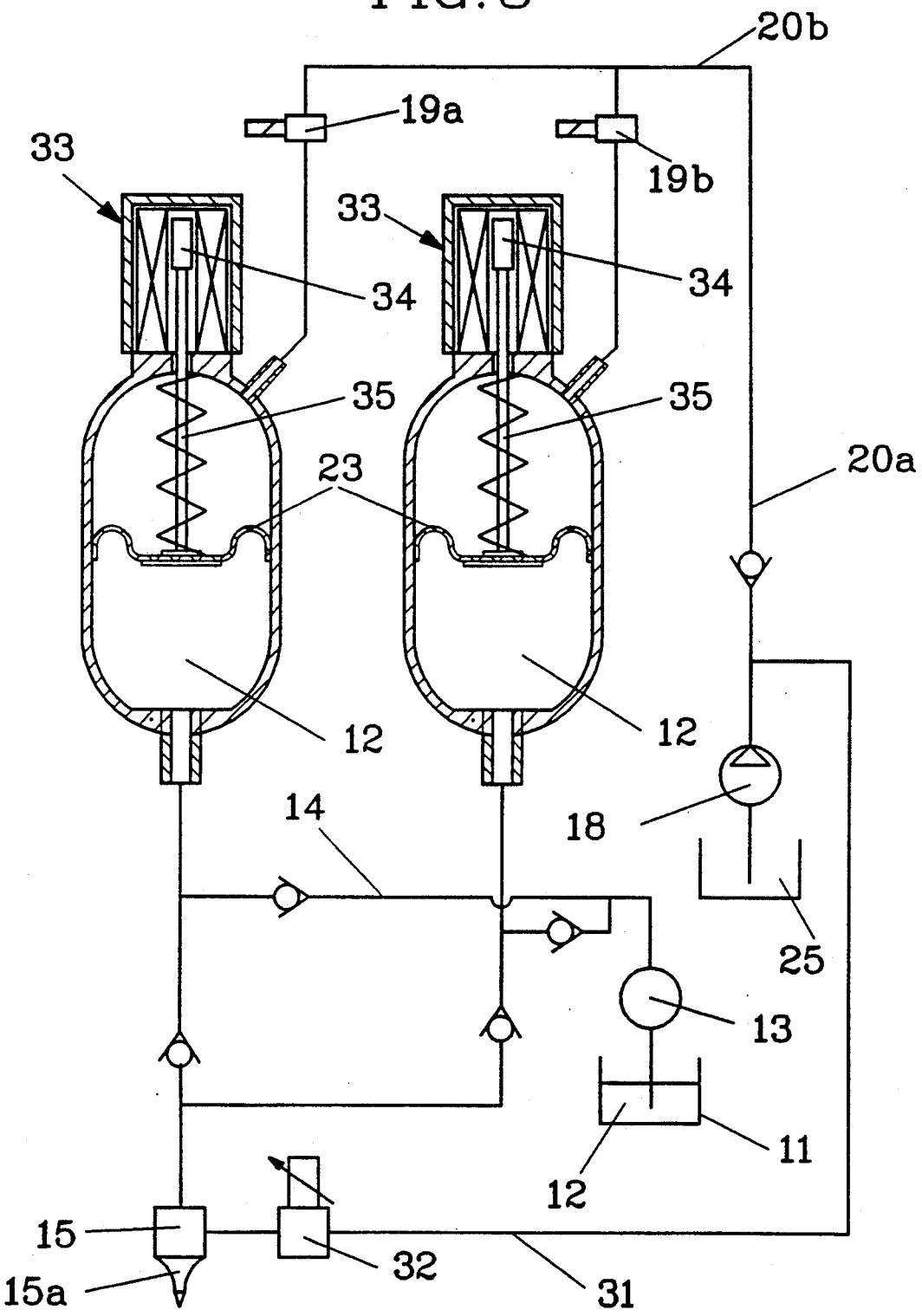
FIG. 3 shows a conduit diagram for a modified device according to the invention.

In the embodiment shown in FIG. 3 there are arranged two boosters 16*a* and 16*b* intended to be connected alternately to the hydraulic pump 18, thus that the substance can be continuously applied on the object. The valve body 28 of the control valve 15 is controlled by a servo valve 32.

The two pressure generators 16*a* and 16*b* in their upper part are provided with a sensor 33, e.g. in the form of a transducer 34, which via a rod 35 is connected to the membrane 23 of the accumulator. The sensor 33 is used on one hand for indicating that substance has been discharged and to what volume and on the other hand to emit a signal in time to a control unit (not shown), which starts the filling up of an emptied accumulator.

I claim:

1. A device for dispensing a string or dab of liquid or plastic substance, such as putty, glue, paint or lubricant, to an object, the device comprising:

a nozzle including a fine discharge passage;

a first conduit which is connected to the nozzle;

a pump for feeding the substance through the conduit to the nozzle;

a booster which is connected to the conduit between the pump and the nozzle;

pressure medium supplying means for supplying pressure medium to the booster, the pressure medium supplying means including a second conduit, the second conduit being connected to the booster;

a substance control valve for controlling flow of the substance through the nozzle, the substance control valve being connected to the pressure medium and including a chamber which is in fluid communication with the discharge passage of the nozzle;

the substance control valve further including: a valve seat located between the first conduit and the chamber;

a valve body which is biased in a closing direction by the substance and which is biased in an opening direction by the pressure medium;

an actuator located within said chamber for moving the valve body away from said valve seat, said actuator is connected to the pressure medium and comprises a pressure member, one side of which is actuated by the pressure medium and the opposite side of which is actuated by the substance, the area of said pressure member is considerably larger than the area of said valve body; and said device further including a pressure medium control valve which upon actuation will cause the pressure medium to act upon said pressure element so as to move the valve body in an opening direction, thereby dispensing the substance through the nozzle.

2. The device as claimed in claim 1, wherein said pressure medium control valve is a servo valve the operation of which is separate from the supply of pressure medium to the booster.

3. A device for dispensing a string or dab of liquid or plastic substance, such as putty, glue, paint or lubricant, to an object, the device comprising:

a nozzle including a fine discharge passage;

a first conduit which is connected to the nozzle;

a pump for feeding the substance through the conduit to the nozzle;

a booster which is connected to the conduit between the pump and the nozzle;

pressure medium supplying means for supplying pressure medium to the booster, the pressure medium supplying means including a second conduit, the second conduit being connected to the booster;

a substance control valve for controlling flow of the substance through the nozzle, the substance control valve being connected to the pressure medium and including a chamber which is in fluid communication with the discharge passage of the nozzle;

the substance control valve further including: a valve seat located between the first conduit and the chamber;

a valve body which is biased in a closing direction by the substance and which is biased in an opening direction by the pressure medium;

an actuator located within said chamber for moving the valve body away from said valve seat, said actuator is connected to the pressure medium and comprises a pressure member, one side of which is actuated by the pressure medium and the opposite side of which is actuated by the substance, the area of said pressure member is considerably larger than the area of said valve body; and said device further including a pressure medium control valve which upon actuation will cause the pressure medium to act upon said pressure element so as to move the valve body in an opening direction, thereby dispensing the substance through the nozzle, said pressure medium control valve is a servo valve the operation of which is separate from the supply of pressure medium to the booster, the pressure of the pressure medium acting on the substance control valve is adjustable by means of said servo valve, thereby controlling the pressure of the substance dispensed through the nozzle.

4. The device as claimed in claim 3, wherein the nozzle has a fine discharge passage, the flow resistance of the passage being greater than the force of the pump.

5. The device as claimed in claim 3, wherein the booster includes a pressure vessel and subdividing means for subdividing the pressure vessel into a pressure medium chamber and a substance chamber, and wherein a sensor is provided for sensing the position of the subdividing means.

6. The device as claimed in claim 5, further comprising a second booster and means for alternatively feeding the substance to the boosters from the pump.

7. A device for dispensing a string or dab of liquid or plastic substance, such as putty, glue, paint or lubricant, to an object, the device comprising:

a nozzle including a fine discharge passage;

a first conduit which is connected to the nozzle;

a pump for feeding the substance through the conduit to the nozzle, the flow resistance of the discharge passage of the nozzle being greater than the force of the pump;

a booster which is connected to the conduit between the pump and the nozzle;

pressure medium supplying means for supplying pressure medium to the booster, the pressure medium supplying means including a second conduit, the second conduit being connected to the booster;

a substance control valve for controlling flow of the substance through the nozzle, the substance control valve being connected to the pressure medium and including a chamber which is in fluid communication with the discharge passage of the nozzle;

the substance control valve further including:

a valve seat located between the first conduit and the chamber;

a valve body which is biased in a closing direction by the substance and which is biased in an opening direction by the pressure medium;

an actuator located within said chamber for moving the valve body away from said valve seat, said actuator being connected to the pressure medium and comprising a pressure member, one side of which is actuated by the pressure medium and the opposite side of which is actuated by the substance, the area of said pressure member is considerably larger than the area of said valve body; and said device further including a pressure medium control valve which upon actuation will cause the pressure medium to act upon said pressure element so as to move the valve body in an opening direction, thereby dispensing the substance through the nozzle.

8. A device for dispensing a string or dab of liquid or plastic substance, such as putty, glue, paint or lubricant, to an object, the device comprising:

a nozzle including a fine discharge passage;

a first conduit which is connected to the nozzle;

a pump for feeding the substance through the conduit to the nozzle, the flow resistance of the discharge passage of the nozzle being greater than the force of the pump;

a booster which is connected to the conduit between the pump and the nozzle, the booster including a pressure vessel and subdividing means for subdividing the pressure vessel into a pressure medium chamber and a substance chamber;

a sensor for sensing the position of the subdividing means;

pressure medium supplying means for supplying pressure medium to the booster, the pressure medium supplying means including a second conduit, the second conduit being connected to the booster;

a substance control valve for controlling flow of the substance through the nozzle, the substance control valve being connected to the pressure medium and including a chamber which is in fluid communication with the discharge passage of the nozzle;

the substance control valve further including:

a valve seat located between the first conduit and the chamber;

a valve body which is biased in a closing direction by the substance and which is biased in an opening direction by the pressure medium;

an actuator located within said chamber for moving the valve body away from said valve seat, said actuator being connected to the pressure medium and comprises a pressure member, one side of which is actuated by the pressure medium and the opposite side of which is actuated by the substance, the area of said pressure member is considerably larger than the area of said valve body; and said device further including a pressure medium control valve which upon actuation will cause the pressure medium to act upon said pressure element so as to move the valve body in an opening direction, thereby dispensing the substance through the nozzle.

9. The device as claimed in claim 8, wherein it further comprises a second booster and means for alternatively feeding ths substance to the boosters from the pump.

* * * * *